United States Patent [19]

Sano et al.

[11] Patent Number: 4,619,127

[45] Date of Patent: Oct. 28, 1986

[54] ELECTROMAGNETIC FORMING METHOD BY USE OF A DRIVER

[75] Inventors: Toshio Sano, Yatabemachi; Masaharu Takahashi, Takezono; Yoichi Murakoshi, Yatabemachi; Kenichi Matsuno, Tokyo, all of Japan

[73] Assignees: Agency of Industrial Science & Technology; Ministry of International Trade & Industry, both of Tokyo, Japan

[21] Appl. No.: 705,524

[22] Filed: Feb. 26, 1985

[30] Foreign Application Priority Data

Feb. 29, 1984 [JP] Japan ..... 59-39056

[51] Int. Cl.[4] ..... B26D 26/14

[52] U.S. Cl. ..... 72/56; 29/421 M

[58] Field of Search ..... 72/54, 56, 57; 29/421 M; 336/222, 223

[56] References Cited

U.S. PATENT DOCUMENTS

| | | | |
|---|---|---|---|
| 3,149,372 | 9/1964 | Stinger . | |
| 3,222,771 | 12/1965 | Schwinhamer | 29/421 M |
| 3,231,842 | 1/1966 | Brower et al. | 336/182 |
| 3,407,637 | 10/1968 | Dietz . | |
| 3,447,350 | 6/1969 | Schenk . | |
| 3,703,958 | 11/1972 | Kolm | 72/56 |
| 4,061,007 | 1/1976 | Hansen | 72/56 |
| 4,116,031 | 9/1978 | Hansen | 72/56 |

*Primary Examiner*—Leon Gilden

*Attorney, Agent, or Firm*—Oblon, Fisher, Spivak, McClelland & Maier

[57] ABSTRACT

An electromagnetic forming method is disclosed which effects desired forming on a given workpiece by disposing on the surface of the workpiece a driver obtained by superposing a highly electroconductive metal foil repeatedly over itself, opposing a primary coil to the driver, feeding electric current for forming to the primary coil thereby generating induced current in the driver, and allowing the workpiece to be formed by the resultant repulsive force exerted between the driver and the primary coil.

6 Claims, 7 Drawing Figures

ELECTROMAGNETIC FORMING METHOD BY USE OF A DRIVER

BACKGROUND OF THE INVENTION

1. Field of the Invention

This invention relates to an electromagnetic forming method by use of a driver. This forming embraces a geometrical correction which entails substantially no dimensional change. The term "driver" as used regarding this invention means a highly electroconductive material which is formed in conjunction with a workpiece.

2. Description of the Prior Art

When the electric current flowing through a conductor is varied, the intensity of the magnetic field generated around the conductor is also varied. When another conductor exists in the magnetic field so varied, an induced current flows through that conductor in the direction impeding the variation of the magnetic field. Consequently, the electric current is affected by the force (Lorentz force) according with Flemming's left-hand rule. The method of forming an object by the use of this force is called electromagnetic forming. To be specific, when electric energy is supplied to a primary coil, an induced current is produced in a secondary coil (workpiece) and the repulsive force consequently generated between the primary coil and the workpiece effects desired forming of the workpiece.

Electromagnetic forming is characterized in that the forming is effected at an extremely high speed of within 1 ms, the forming force is allowed to act on the workpiece without contact, the forming can easily be controlled and automated as compared with any other high-energy rate forming method, and the forming can be carried out with a simple metal die without inevitably requiring a male die. Electromagnetic forming is capable of bulging or swaging a tubular material, fastening a flange around a tubular material, boring holes in a tubular material, forming a plate-like material. (High-Velocity Forming of Metals; Revised Edition, Manufacturing Data Series, The American Society of Tool and Manufacturing Engineers, 1968.)

Heretofore, in electromagnetic forming of a workpiece of such material as ferrous metal (stainless steel or carbon steel), titanium alloy, or magnesium alloy which has high electric resistance and/or transforming resistance and, therefore, is difficult to work or of such material which has an extremely small thickness and, therefore, is not amply affected by electromagnetic force, it has been customary to oppose a highly electroconductive driver of aluminum or copper as a secondary coil to a primary coil used for the forming. When a tubular workpiece is to be bulged, for example, a tubular driver smaller in diameter than the workpiece is inserted in the central hole of the workpiece with no gap therein. When a tubular workpiece is to be swaged, a tubular driver larger in diameter than the workpiece is wrapped around the workpiece. When a plate-like workpiece is to be formed, a plate-like driver is held fast against the workpiece. Then, the primary coil is opposed to each of the drivers mentioned above. (Electromagnetic Forming (EMF), Metals Handbook, Vol. 4 FORMING, 8th EDITION (1969), American Society for Metals.)

The wall thickness of the driver cannot be reduced below a certain level. The driver is constructed in a thickness of about 0.5 to 0.8 mm, for example, so as not to be deformed easily. Owing to its construction, therefore, the driver has given rise to various problems as described below. Since the driver itself is relatively thick and highly rigid, the electromagnetic forming requires a large amount of energy not only for the formation of the workpiece but also for the deformation of the driver itself. Thus, electromagnetic forming has entailed low energy utilization efficiency. To preclude occurrence of electric discharge between the workpiece and the driver during forming, the workpiece and the driver are required to be held in tight enough contact to preclude occurrence of a gap therebetween. Since dimensions of the driver cannot easily be changed, the driver lacks the flexibility required for meeting possible dimensional variation among the workpieces. Whenever a given workpiece has a different size or shape, it becomes necessary to prepare a new driver which conforms to the size or shape of the workpiece. Since electromagnetic forming is a method suitable for small-lot production of a wide variety of articles, the drivers used are required to be produced in small lots, which leads to an increase in the cost of production. There are times when workpieces make it virtually impossible to attach such drivers thereto because of their size, shape, etc. After completion of the forming, the drivers must be removed from the formed workpieces. Depending on the shape, for example, of the finished workpiece, the removal of the drivers not infrequently proves extremely difficult because all the drivers have thick walls and relatively high strength. Moreover, the drivers are destined to be discarded after use instead of being put to re-use. Since they are produced with thick walls, the cost of their material is so high as to increase the cost of production.

The present invention has issued from efforts directed to eliminating the drawbacks of the prior art described above. An object of the invention is to provide a method of enabling a workpiece of high electric resistance and/or high deforming resistance or workpieces which are difficult to electromagnetically form to be easily, efficiently, and economically formed or corrected.

SUMMARY OF THE INVENTION

In electromagnetic forming by the use of a driver of the nature described above, this invention utilizes a driver formed by superposing a plurality of metal foils abounding in electroconductivity. Even when such metal foils are piled up to a fairly large thickness, the resultant laminate enjoys sufficient flexibility to be attached to and removed from a workpiece with ease. Even when a given workpiece is of non-standard shape, metal foils can easily be superposed wherever they are required. Thus, the use of metal foils is economical because it serves to lower the cost of the material for the drivers.

The other objects and characteristic features of this invention will become apparent to those skilled in the art as the disclosure is made in the following description of a preferred embodiment of the invention, as illustrated in the accompanying drawings.

DESCRIPTION OF PREFERRED EMBODIMENTS

Figure 1:
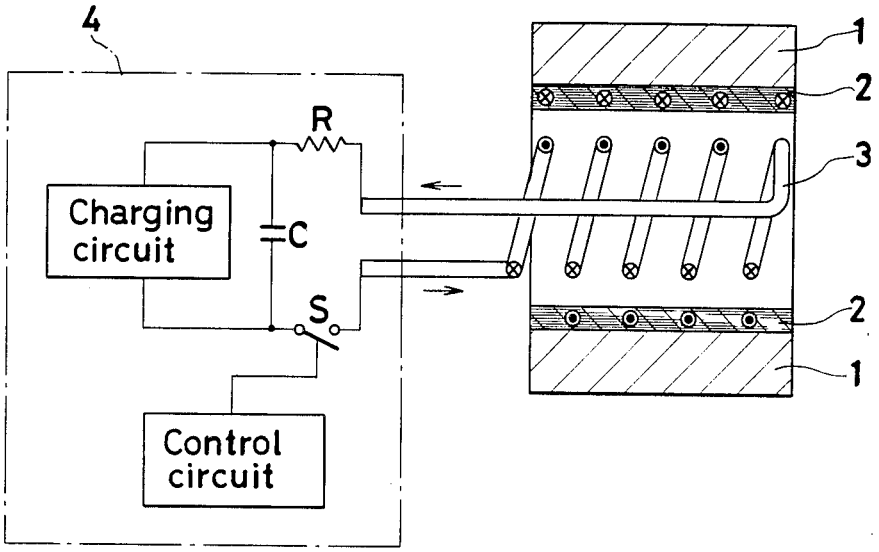
FIG. 1 is an explanatory view illustrating a tube being bulged by the present invention.

FIG. 1 illustrates an arrangement for bulging a tubular workpiece 1 of a material high in electric resistance and/or deforming resistance and difficult to form. The workpieces to which this invention is applicable include not only those of stainless steel, titanium alloys, and ferrous metals which are difficult to form but also those with extremely thin walls or highly complicated shapes and high in electric resistance. In the electromagnetic forming of the aforementioned tubular workpiece 1, a laminated driver 2 serving as a secondary coil is attached on the inner wall surface of the tubular workpiece by winding or otherwise disposing a metal foil high in electroconductivity in a superposed state. The metal foil to be used for this purpose may be made of any material solely on the condition that it has high electroconductivity and high formability. In due consideration of economy and practical utility, copper foil and aluminum foil may be cited as typical examples. The width of the metal foil should be suitably selected in accordance with the size of the workpiece given to be formed or corrected. For example, a metal foil having a width equaling the axial length of the workpiece 1 may be wound around along the inner wall surface of the workpiece or a metal foil having a width smaller than the aforementioned axial length may be spirally wound around along the inner wall surface. In this case, when the metal foil is made of a material possessing rigidity, it can be easily superposed in a state held tightly against the inner wall. Since the metal foil is highly flexible, it can be wound intimately, when necessary with the aid of an adhesive tape, on the surface of a given workpiece 1 without reference to the complexity of the shape of the workpiece. The driver so formed by the winding of the metal foil is also highly flexible.

The number of layers which the metal foil is desired to produce by being so wound is decided by the thickness of the metal foil and the skin depth of the induced current to be passed through the driver consequently obtained. The number of layers proves satisfactory when the driver obtained by the superposition of the metal foil acquires the thickness large enough for the flow of the aforementioned induced current. Since the high-frequency current flows only in the surface layer of a given material, the driver is only required to have a thickness equal to the skin depth $\delta$. This depth of the surface layer $\delta$ can be determined by the following formula.

$$\delta = \sqrt{\frac{2\rho}{\mu\omega}}$$

In the formula, $\rho$ stands for the resistivity of the workpiece (foil), $\mu$ for the permeability in a vacuum, and $\omega$ for the angular frequency of the current.

Figure 2:
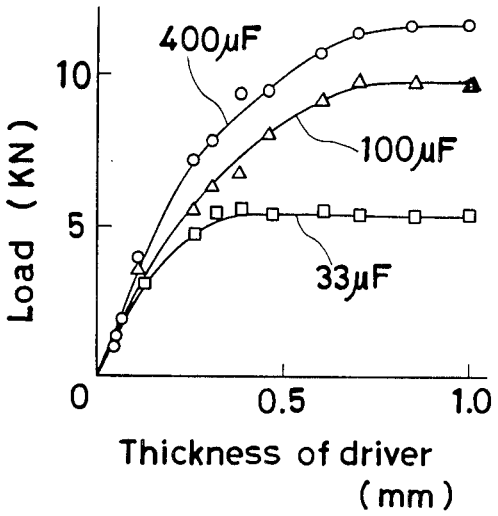
FIG. 2 is a graph showing the relation between the thickness of a driver and the load.

The relation between the thickness of a driver made of copper and the magnitude of the load exerted upon a workpiece was determined by actual measurement. The results are shown in FIG. 2. The load was determined by opposing a coil and a workpiece to each other across an intervening space of 2 mm and measuring the repulsive force generated therebetween by means of a crystal piezoelectric load converter through the medium of a bakelite cylinder 80 mm in diameter and 140 mm in length. With reference to FIG. 1, when the capacitance of the capacitor C is 33 $\mu$F, the electromagnetic force levels off to a constant value as the thickness of the driver increases past 0.5 mm. When the capacitance is 100 $\mu$F and 400 $\mu$F respectively, the constant electromagnetic force is obtained as the thickness of the driver reaches about 0.7 mm and about 0.9 mm. These values substantially agree with the theoretical values calculated by the aforementioned formula.

When the number of layers of the metal foil is not sufficient, the produced driver has an insufficient thickness and therefore fails to pass the induced current as amply as expected. Consequently, the repulsive force exerted upon the driver and the workpiece is small and the amount of deformation is proportionately small. When the number of layers of the metal foil reaches a certain value, the amount of the induced current allowed to flow is sufficient and the repulsive force exerted upon the driver and the workpiece is large enough to cause ample deformation of the workpiece. When the number of layers of the metal foil is greater than is required, there ensues the disadvantage that the amount of deformation obtained in the workpiece decreases because the amount of induced current allowed to flow through the driver is not increased despite an increase in the amount of energy required for the deformation of the driver itself. The primary coil (solenoid coil) 3 to be opposed to the aforementioned driver 2 is inserted into the driver 2. An electric circuit 4 for instantaneous flow of electric current for forming is connected to the coil 3. The aforementioned electric circuit 4 is composed of a charging circuit, capacitors C for storing the electric energy from the charging circuit, a resistance R, a control circuit, and a switch S adapted to be opened and closed as controlled by the control circuit.

When necessary, a die may be disposed around the workpiece 1.

In FIG. 1, when the switch S is closed by the signal from the control circuit on completion of the charging of the capacitor C, the electric current from the capacitor C flows through the primary coil 3 in the direction indicated by the arrows. As a result, the induced current flows through the driver 2 is opposed to the coil of the primary coil 3 as indicated in FIG. 1. Owing to the two electric currents so generated, a repulsive force is generated between the driver 2 and the primary coil 3 to bulge the workpiece. During the electromagnetic forming so performed, since the aforementioned driver 2 is highly flexible, only slight energy is spent in the bulging of the driver 2 itself. Thus, the electromagnetic forming is efficiently carried out with small energy. The removal of the driver 2 on completion of the electromagnetic forming can be realized very easily because the metal foil forming the driver is highly flexible.

Figure 3:
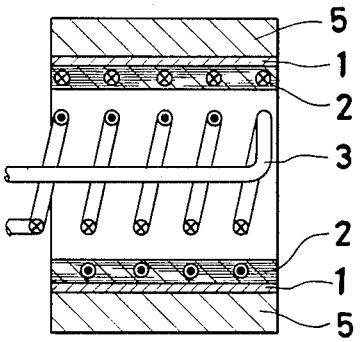
FIG. 3 is an explanatory view illustrating a tube being corrected by the present invention.

When corrective forming entailing substantially no dimensional change is performed on workpieces of high electric resistance and/or high forming resistance or when a thin plate on which the electromagnetic force fails to act sufficiently, the metal foil 2 is wound round to a stated thickness along the inner wall surface of the tubular workpiece 1 and a tubular die 5 is disposed around the outer periphery of the workpiece and electric current is fed to the primary coil 3 inside the tubular workpiece 1 as shown in FIG. 3. Consequently, the workpiece 1 is pressed onto the die and corrected along the inner wall surface of the die 5.

Figure 4:
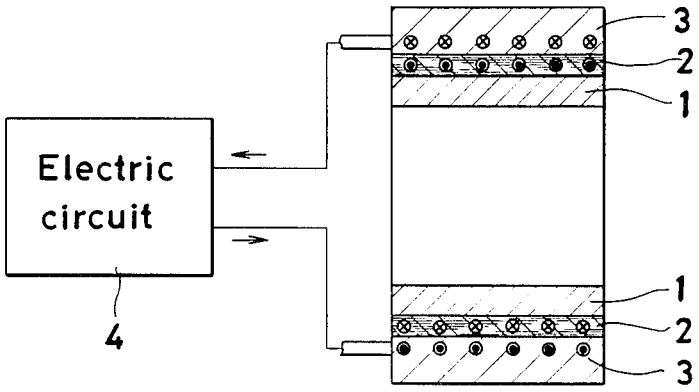
FIG. 4 is an explanatory view illustrating a tube being swaged by the present invention.

FIG. 4 illustrates an arrangement for swaging a tubular workpiece 1 by the method of this invention. On the outer surface of the workpiece 1, the metal foil 2 is wound to a prescribed thickness as tightly pressed to obtain a driver.

The primary coil (solenoid coil) 3 for forming is disposed outside the driver 2. Then electric current is fed to the primary coil 3 via the electric circuit 4. As a result, the induced current flows as illustrated in FIG. 4 through the driver 2 as opposed to the coil of the primary coil 3 and the repulsive force generated consequently between the driver and the primary coil effects desired swaging of the workpiece 1.

Figure 5:
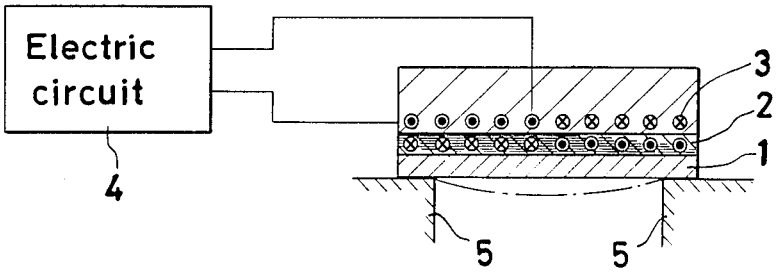
FIG. 5 is an explanatory view illustrating a plate-shaped workpiece being formed by this invention.

FIG. 5 depicts a working example using the driver made of a metal foil for plate deformation. A plate forming coil (primary coil) 3 is obtained by winding a copper wire spirally. When electric current is fed to the coil 3, the induced current flows through the driver 2 as opposed to the coil 3 to give rise to repulsive force between the driver and the coil. This repulsive force is propagated to the workpiece 1 held intimately against the driver 2. Since the workpiece 1 in the illustrated embodiment has its opposite ends retained by the die 5, the workpiece is bulged as indicated by the chain line in FIG. 5. Naturally, corrective forming which relieves a given workpiece of surface roughness and wrap inherent in the material used can be accomplished by placing a die as held intimately against the workpiece.

In accordance with the present invention, since the driver is obtained by superposing a highly flexible metal foil repeatedly over itself, the attachment of the driver to the workpiece prior to the forming and the removal of the driver from the finished work after completion of the forming can be effected very easily irrespective of the shape, size, etc. of the workpiece involved. The method of this invention, therefore, is capable of easily effecting the electromagnetic forming on a workpiece which has heretofore defied electromagnetic forming because of the difficulty experienced in the attachment and removal of the conventional driver. Further by suitable selection of various conditions of electromagnetic forming such as thickness of the driver and magnitude of the voltage applied, the electromagnetic forming can be carried out with high energy utilization efficiency. Moreover, the use of the metal foil as the material for the driver permits a notable saving in the cost of the driver.

EXAMPLE 1

A steel tube 0.3 mm in wall thickness and 53 mm in diameter was used as a workpiece and an aluminum foil 0.015 mm in thickness and a copper foil 0.15 mm in thickness were used as metal foils. On three such steel tubes, the aluminum foils were wound respectively to 0.15 mm, 0.3 mm, and 0.45 mm of thickness to form drivers. On two such steel tubes, the copper foils were wound respectively to 0.15 mm and 0.3 mm of thickness to form drivers.

Primary coils were disposed one each around the drivers so formed. With the charging energy for the capacitor fixed at 1.8 kJ, the energy was discharged through the primary coils to effect swaging of the tubes.

Figure 6:
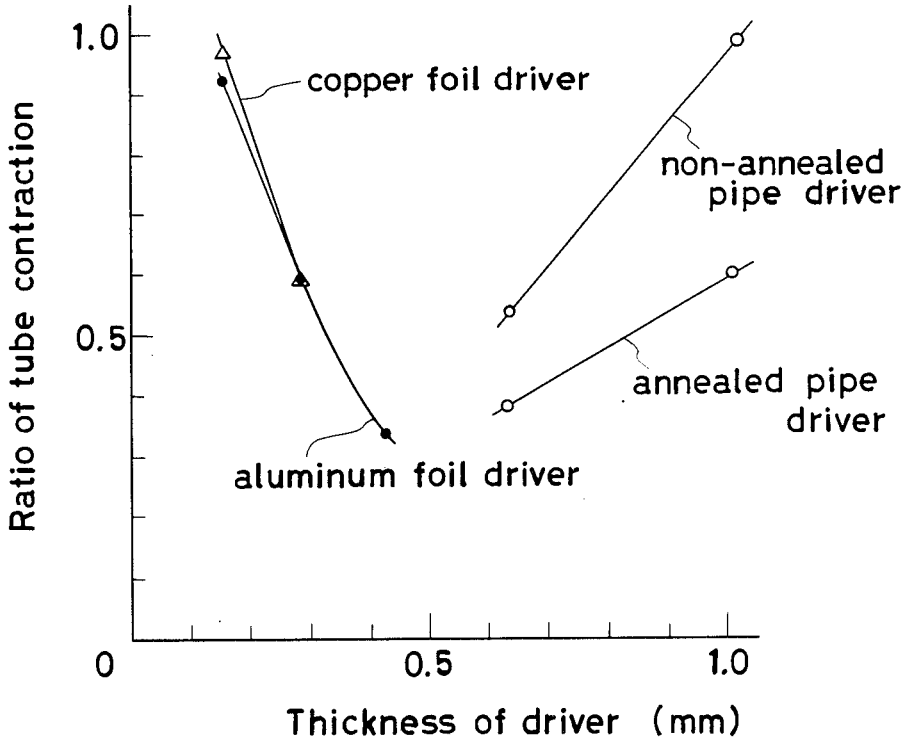
FIG. 6 is a graph showing the relation between the thickness of a driver and the ratio of tube contraction.

The results were as shown in FIG. 6. For comparison, aluminum tubes (non-annealed grade and annealed grade) according to JIS A6063 and having wall thicknesses of 0.6 mm and 1.0 mm were used as drivers. Steel tubes with same dimensions as those mentioned above were inserted in these drivers and subjected to swaging under the same conditions as described above. The results are also shown in FIG. 6.

It is noted from the data of FIG. 6 that the ratio of tube contraction (the ratio of the cross-sectional area of the tube after contraction to the cross-sectional area of the tube before contraction) reaches about 0.3 where the driver obtained by winding an aluminum foil in a thickness of 0.45 mm and that for a fixed charging energy, the method of this invention brings about at least an equal amount of tube deformation to that by the conventional method using a pipe as a driver.

EXAMPLE 2

Six soft steel pipes 0.2 mm in wall thickness and 60 mm in diameter were prepared.

On each of the inner wall surfaces of three of the six pipes was formed a driver of an aluminum foil tape 20 mm in width and 0.02 mm in thickness by winding the tape six times. The three pipes were bulged by inserting primary coils one each thereinto so as to be opposed to the drivers and discharging electrical energy of 3.2, 4.1 and 5.0 kJ ($C=100\ \mu F$) respectively to the primary coils.

On each of the inner wall surfaces of the remaining three pipes was formed a driver of a copper foil tape 10 mm in width and 0.2 mm in thickness by winding the tape twice. The three pipes were bulged by following the procedures as described hereinbefore.

Figure 7:
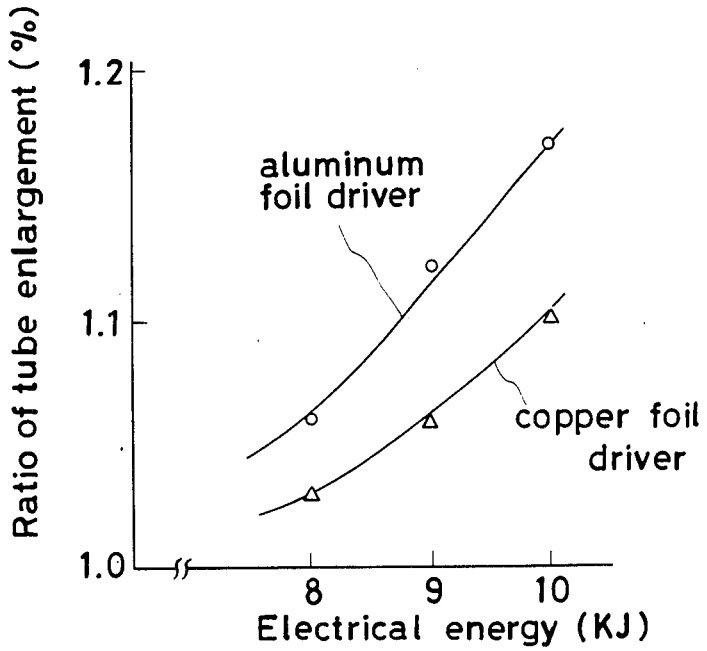
FIG. 7 is a graph showing the relation between the electrical energy supplied and the ratio of tube enlargement.

The results were as shown in FIG. 7, from which it is noted that the ratio of tube enlargement in diameter (the ratio of the cross-sectional area of the tube after enlargement in diameter to the cross-sectional area of the tube before enlargement in diameter) was largest in the application of energy of 5.0 kJ.

For comparison, a soft steel pipe of the same size not having any driver was tested for enlargement in diameter by inserting a primary coil thereinto and applying energy of 5.0 kJ ($C=100\ \mu F$). As a result, the tube diameter was observed to have no substantial change.

What is claimed is:

1. A method of electromagnetic forming, comprising the steps of:

disposing on the surface of a workpiece a driver obtained by superposing a highly electroconductive metal foil repeatedly over itself wherein said driver serves to act as a secondary coil which opposes a primary coil;

feeding an electric current to said primary coil so as to produce an induced current in said driver; and forming said workpiece with the repulsive force generated by the induced current generated in said driver.

2. The method according to claim 1, wherein said driver is formed by the step of winding an aluminum foil as said metal foil.

3. The method according to claim 1, wherein said driver is formed by the step of winding a copper foil as said metal foil.

4. The method according to claim 1, wherein said workpiece is formed by the step of utilizing a very thin-walled tube.

5. The method according to claim 1, wherein said workpiece is formed by the step of utilizing a very thin plate.

6. The method according to claim 1, comprising the further step of disposing a die on the rear surface of said workpiece to effect correction of said workpiece.

* * * * *